US005884729A

United States Patent [19]

Park et al.

[11] Patent Number: 5,884,729

[45] Date of Patent: Mar. 23, 1999

[54] APPARATUS AND METHOD FOR CONTROLLING A PLURALITY OF ELEVATOR CARS

[75] Inventors: Jong-Hun Park, Kwangmyung; Eung-Lyeol Koh, Inchon; Sung-Joon Park, Seoul, all of Rep. of Korea

[73] Assignee: LG Industrial Systems Co., Ltd., Seoul, Rep. of Korea

[21] Appl. No.: 773,255

[22] Filed: Dec. 23, 1996

[30] Foreign Application Priority Data

Dec. 28, 1995 [KR] Rep. of Korea ..... 1995/62098

[51] Int. Cl.[6] ..... B66B 1/28

[52] U.S. Cl. ..... 187/248; 187/380

[58] Field of Search ..... 187/247, 248, 187/380, 382

[56] References Cited

U.S. PATENT DOCUMENTS

| | | | |
|---|---|---|---|
| 4,114,730 | 9/1978 | Means et al. | 187/29 R |
| 4,989,695 | 2/1991 | Kubo | 187/101 |
| 5,142,107 | 8/1992 | Yasuhiro | 187/127 |
| 5,654,631 | 8/1997 | Farbee et al. | 187/247 |

*Primary Examiner*—Robert E. Nappi
*Attorney, Agent, or Firm*—Oliff & Berridge, PLC

[57] ABSTRACT

An apparatus and method for controlling a plurality of elevator groups each of which has at least a pair of elevator cars. The apparatus includes a master car controller for collecting data from and controlling a plurality of hall calls, cage calls and motors to thereby manage a respective group of elevator cars, and at least one slave car controller for receiving and internally backing up an allocation command and control command value from the master car controller to thereby control the hall calls, the cage calls and the motors in accordance therewith, thereby enhancing the operating stability of the elevator system.

7 Claims, 8 Drawing Sheets

APPARATUS AND METHOD FOR CONTROLLING A PLURALITY OF ELEVATOR CARS

BACKGROUND OF THE INVENTION

1. Field of the Invention

The present invention relates to an apparatus for controlling a group of elevator cars, and more particularly to an apparatus and method for controlling a group of elevator cars wherein one of plural separate elevator car controllers controls all the elevator cars within the group, without being provided with an extra car group controller and at this time the other car controllers are backed up for data related to controlling the group of elevator cars so that when an error occurs in an elevator car controller another car controller can succeed to take control from the problem car controller, thereby improving system stability.

2. Description of the Prior Art

In general, multi-story buildings are furnished with a plurality of elevator cars which require to employ a system for efficiently controlling the cars.

A car group control system systematically organizes a plurality of elevator cars using a sophisticated microcomputer and a communication link to provide quality service to hall and cage passengers. That is, when there occurs a hall call, the system serves to allocate an optimally selected car to the hall passengers by estimating a variety of factors such as location, speed, direction, door closing status, possible number of additional passengers and the like.

To decrease a waiting time of hall passengers while maximizing the carriage capacity of elevator cars, and to save energy, an elevator car control system employs a method in which a new hall call is allocated to a selected elevator car.

In such a conventional system for controlling a plurality of elevator cars, an extra apparatus is provided to improve the service quality and efficiency so that a double structured system including an extra apparatus is employed to prevent a breakdown which may result from the attached apparatus. However, such a double structured apparatus incurs an increased production and maintenance costs.

As shown in FIG. 1 illustrating a conventional system for controlling a group of elevator cars, a car controller 100B controls a car 107 and a motor 108. A multi-controller 100A collects data from the car controller 100B to perform an overall control over a group of elevator cars. That is, the car controller 100B collects and sends to the multi-controller 100A data including a present location, a door open/close status, switch modes, a hall call and a cage call of the car 107.

A data collector 104 in the multi-controller 101A collects data including the car status, number of passengers, number of hall calls, door open time and the like. A data processor 103 determines a required traffic amount and recognizes a peak traffic in accordance with the collected data.

A data generator 101 generates data required for allocation. A control unit 102 allocates an elevator car judged to be most appropriate to a present hall call, in accordance with a control program which takes into consideration the data generated in the control unit 102, and when the collected data indicates an error the car operation is halted accordingly.

The multi-controller 101A is controlled by a microcomputer, and a problem occurring in the microcomputer may lead to a deteriorated function and reliability of the entire system, so that to prevent such a problem there are provided, as shown in FIG. 2, a first microcomputer 211 for carrying out a multi-controlling and a second microcomputer 212 having the same function as the first microcomputer 211 and backing up data required to perform a multi-controlling, whereby when there occurs a breakdown in the first microcomputer 211 the backup microcomputer 212 takes over the multi-controlling instead.

As shown in FIG. 2, the conventional multi-controlling system having a double structure includes: a plurality of car controllers 220A–220N; a group controller 211 for carrying out a multi-controlling while communicating with each of the car controllers 220A–220N using a communication link; and a backup unit 212 for periodically receiving and temporarily retaining multi-controlling data from the group controller 211 and carrying out a car group controlling when there occurs an error in the group controller 211.

Each of the plurality of car controllers 220A–220N is composed of a corresponding one of CPUs 221A–221N, a corresponding one of ROMs 223A–223N for storing therein the car program, and a corresponding one of RAMs 222A–222N for storing therein data processed in the CPUs 221A–221N.

The operation of the thusly constituted conventional multi-elevator controlling apparatus will now be described.

The car controllers 220A–220N respectively transmit data related to car calls and driving states to the group controller 211 which in turn performs a group management program based upon the input data so that an optimal driving mode or allocation order mode value is transmitted to the respective car controllers 220A–220N.

While performing the group management program, the backup unit 212 periodically receives and stores therein the required data from the group controller 211.

When a malfunction occurs in the group controller 211, the backup unit 212 carries out a group management control based upon the data stored therein, whereby regardless of an error occurring in a group management controller the car group can be continuously controlled by another group management controller.

However, a breakdown in the backup unit 212 makes it difficult to carry out further group management control.

In a building equipped with a plurality of elevator cars, a pair or more of the cars out of the entire number of cars are formed into several groups, and each of the groups performs an independent group management control, and also because a double structural group management system has a fixed mechanical structure, it has been difficult to change a group from one to another and to carry out an independent management over the groups.

Further, employing an extra backup apparatus for group management has led to a cost increase so that when there are provided two or three elevator cars an elevator group management system is excluded and instead there is applied a parallel control technique of the elevator cars. That is, a plurality of parallel furnished elevator cars are connected to each other by a communication line, and through the communication lines the state of the other cars, i.e., their location and direction, is detected and a hall call is selected by itself. At this time, in the hall call selecting method, a car controller in charge of a selected section allocates a hall call to a respective car.

However, such an operation in accordance with a parallel driving method suffers a decreased functionality compared to a group control system which carries out an optimal allocation in consideration of all the serviceable floors and all the hall and cage calls.

SUMMARY OF THE INVENTION

Accordingly, it is a first object of the present invention to provide an apparatus and method for controlling a group of elevator cars which makes it possible for a car controller selected from among a plurality of elevator car controllers which do not perform a controlling of the group of cars to take control of the group of elevator cars in place of another of the car controllers which has formerly been carrying out the car group controlling due to a breakdown thereof. Accordingly an apparatus for a group controlling can be removed.

It is a second object of the present invention to provide an apparatus and method for controlling a group of elevator cars wherein an alternate car controller can carry on controlling the group of cars without requiring installing an additional car group controlling apparatus, by storing a car group control program in a plurality of car controllers, irrespective of a breakdown of a primary car controller.

It is a third object of the present invention to provide an apparatus and method for controlling a group of elevator cars wherein a pair or more of a plurality of car controllers are incorporated into groups, each of which is independently controlled so that a car grouping can be reassigned anew at a time when there is a structural modification of the building, thereby obtaining flexibility of a car group controlling.

To achieve the above-described objects, the provided apparatus for controlling a plurality of elevator groups each of which has at least a pair of elevator cars includes a master car controller for collecting data from and controlling a plurality of hall calls, cage calls and motors to thereby manage a respective group of elevator cars and at least one slave car controller for receiving and internally backing up allocation command and control command values from the master car controller to thereby control the hall calls, the cage calls and the motors in accordance therewith.

Further, the provided method according to the present invention for controlling a plurality of elevator groups each of which has at least a pair of elevator cars, wherein each of the groups carries out an independent car group controlling, includes a first step for selecting a car controller to serve as a master car controller for performing a car group control, from among a plurality of car controllers so that the rest of the plurality of car controller other than the selected master controller are set as slave car controllers, a second step for, when there occurs an error in the previously selected master car controller, selecting as a new master car controller a car controller from among the slave car controllers, and a third step for notifying the selection of the master car controller to the other car controllers.

DETAILED DESCRIPTION OF THE PRESENT INVENTION

Figure 1:
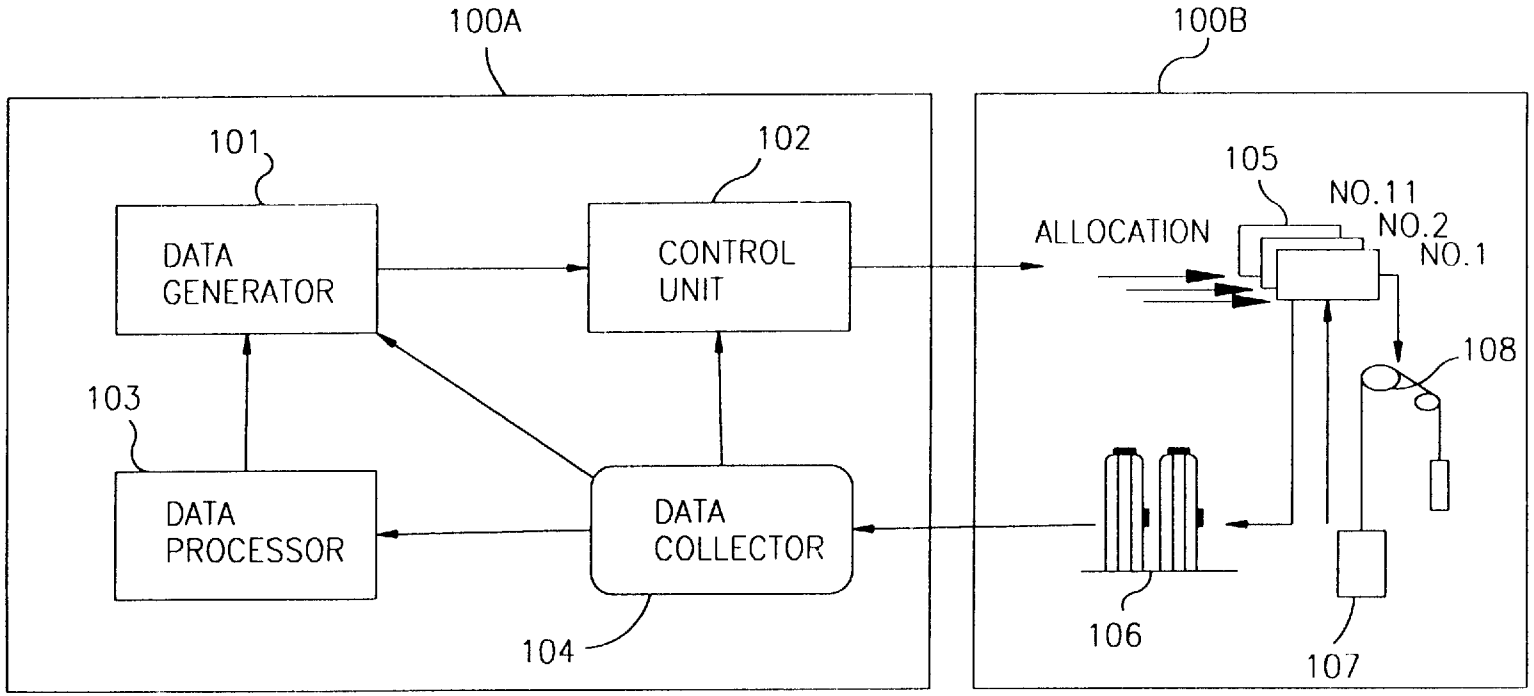
FIG. 1 CONVENTIONAL ART
FIG. 1 is a schematic view of a conventional elevator car group control apparatus.
Figure 2:
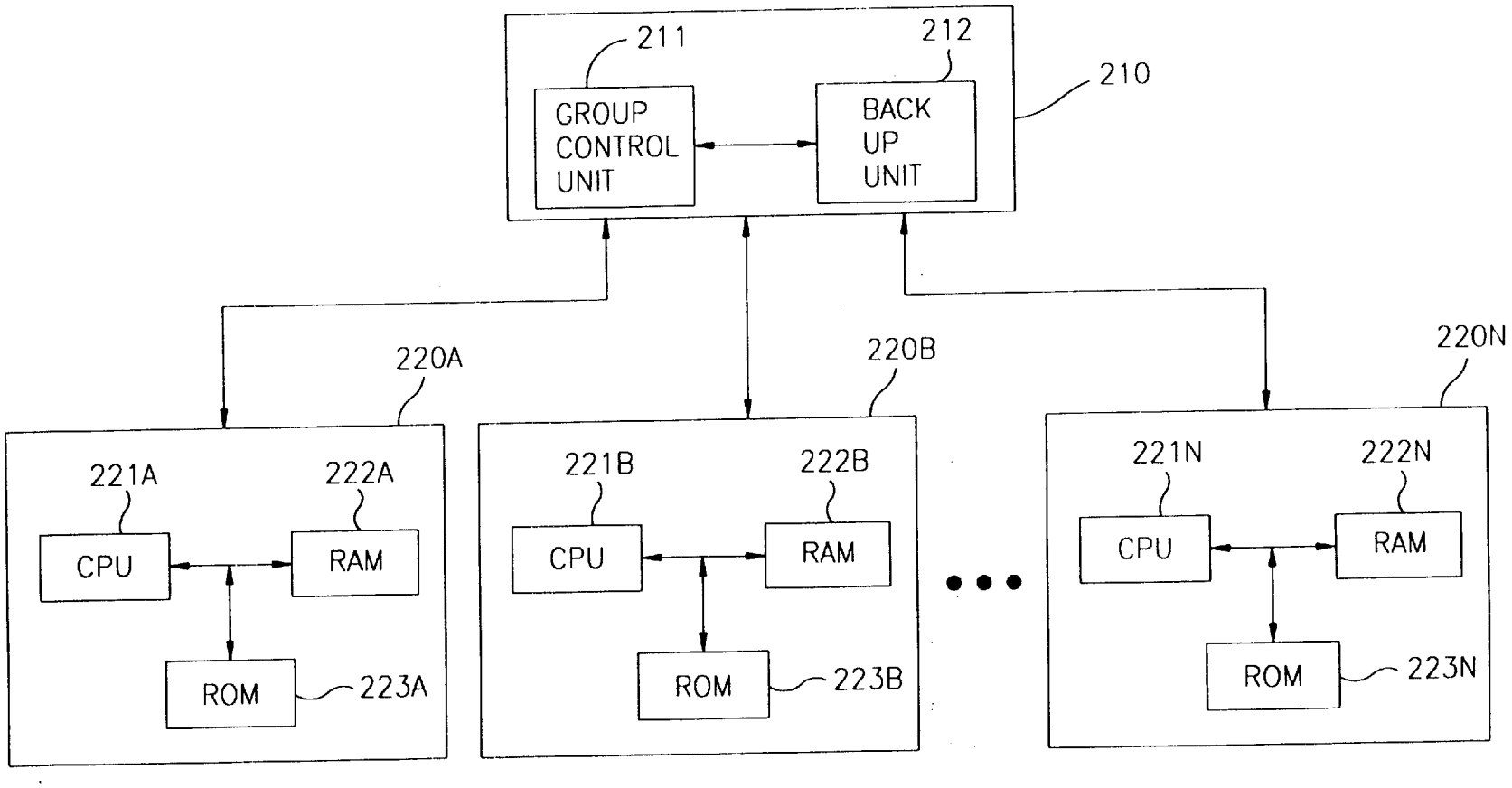
FIG. 2 CONVENTIONAL ART
FIG. 2 is a schematic view of a conventional elevator car control apparatus having a double structured group.
Figure 3:
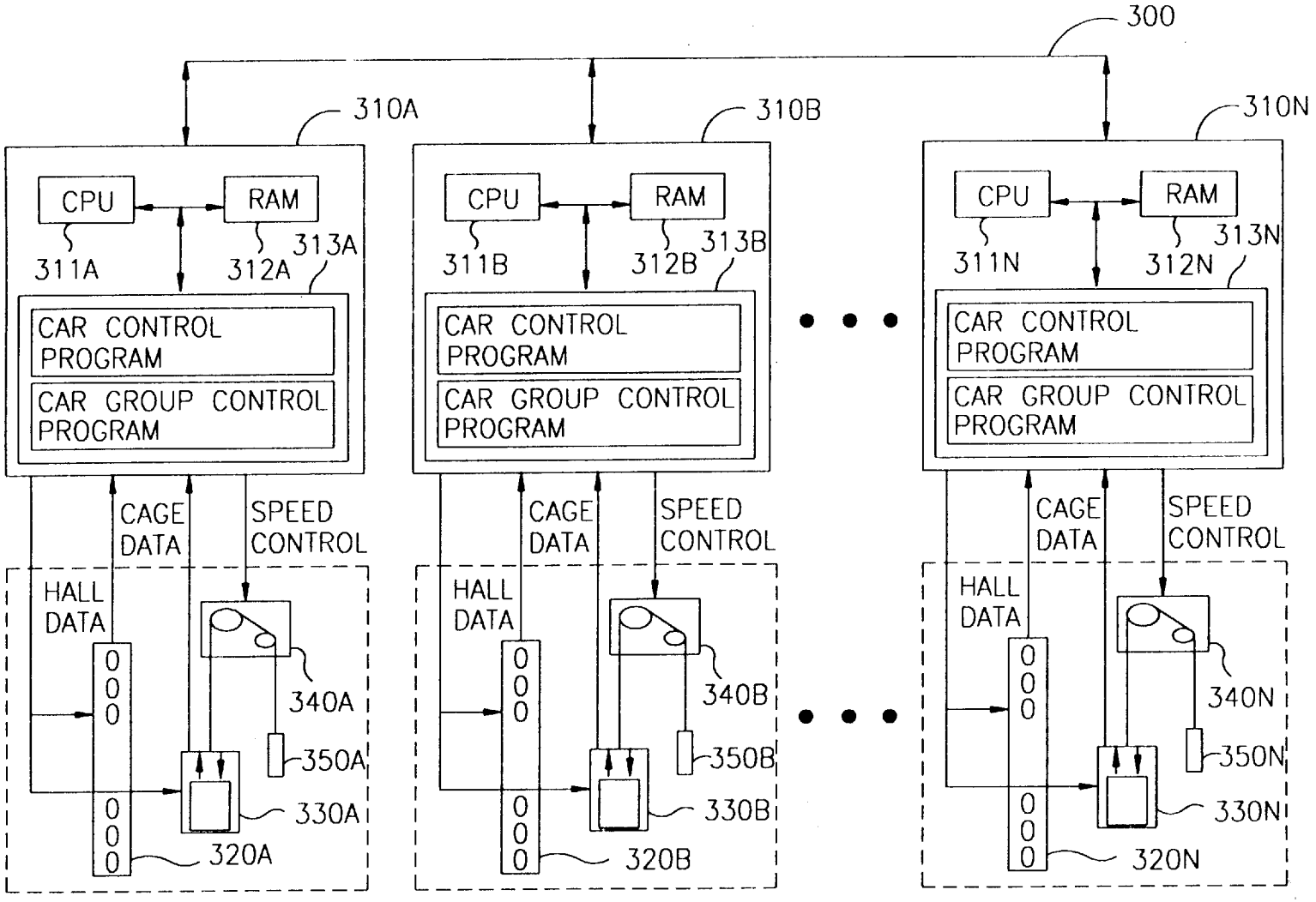
FIG. 3 is a schematic view of a elevator car group control apparatus according to the present invention.

As shown in FIG. 3, each of a plurality of elevator car controllers 310A–310N includes: a corresponding one of a plurality of CPUs 311A–31IN; a corresponding one of a plurality of ROMs 313A–313N each of which stores therein a car control program and a car group control program; and a corresponding one of a plurality of RAMs 312A–312N each of which stores therein data processed in the respective CPUs 311A–311N. Here, the portion controlled by each corresponding one of the plurality of elevator car controllers 310A–310N is composed of a corresponding one of a plurality of hall calls 320A–320N and a corresponding one of a plurality of motors 340A–340N. Reference numeral 300 denotes a communication line.

The car controllers 310A–310N respectively collect hall call data from respective ones of the hall calls 320A–320N and car control data from respective ones of a plurality of elevator cars 330A–330N thus to control a spinning rate of a respective one of the motors 340A–340N, a respective door of the cars 330A–330N, lights and the like, and to output guide data to respective ones of the hall calls 320A–320N. The respective car controllers 310A–310N are connected to each other by the communication line 300.

Figure 4:
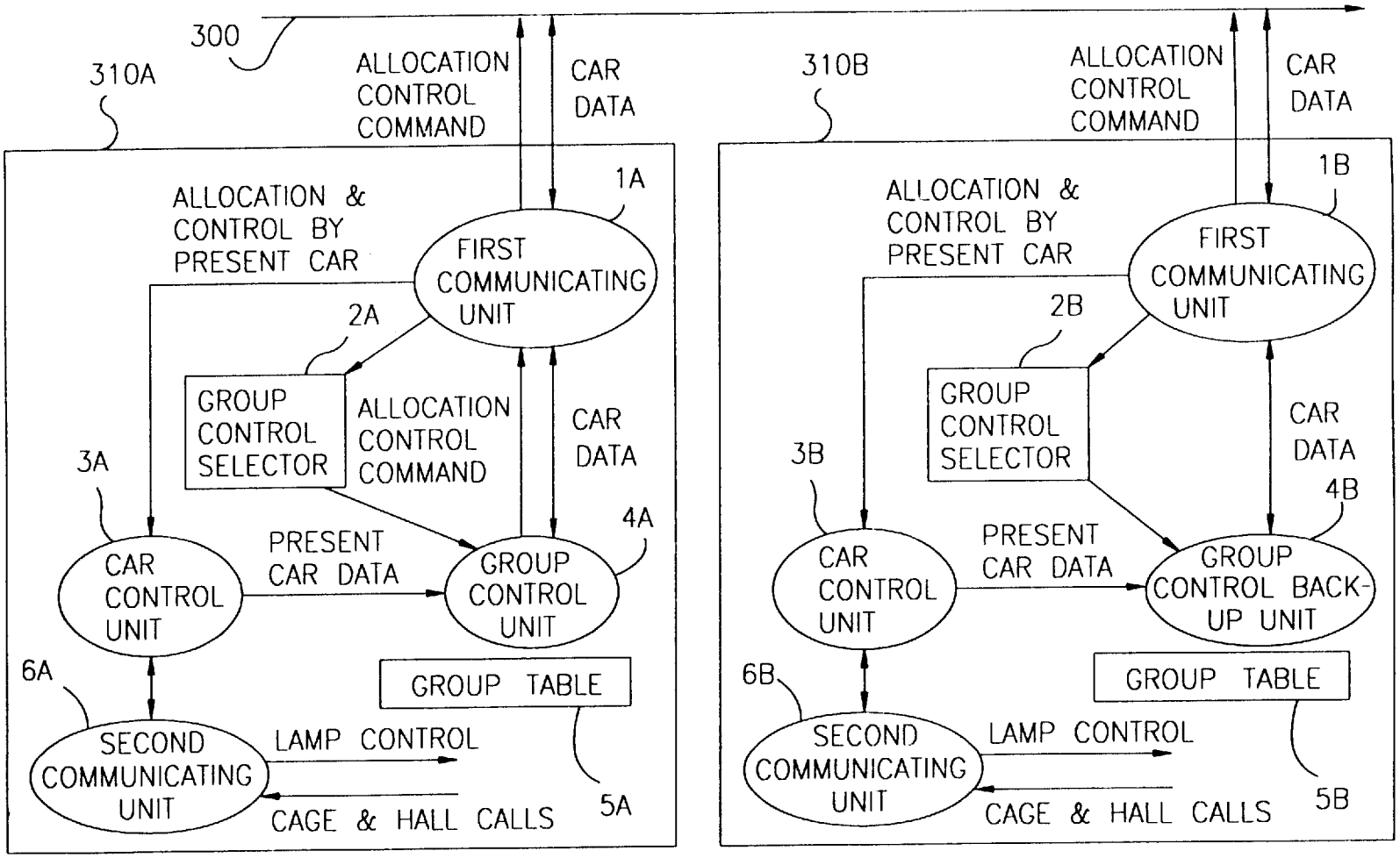
FIG. 4 is a functional view of an elevator car controller in FIG. 3.

FIG. 4 illustrates the functional structure of a car group under the assumption that the car groups are each composed of a pair of car controllers 310A, 310B, wherein the first car controller 310A serving as a master controller carries out a car group controlling operation and the second car controller 310B serving as a slave controller carries out a backup operation.

The master controller 310A performing a group controlling operation includes: a first communication unit 1A in charge of transmitting data through the communication line 300 to the respective car controllers; a car group control unit 4A for collecting and analyzing call data and run data, outputting corresponding control and assigning command signals to the first communication unit 1A, for thereby carrying out an allocation of the calls; a car control unit 3A for receiving control and allocation command signals from the car group control unit 4A to control the operation of a corresponding car and providing run data to the car group control unit 4A; a second communication unit 3A in charge of data communication between the car control unit 3A and the corresponding car and hall call; a group control selector 2A for selecting an elevator car controller for being in charge of a group controlling; and a group controlling table 5A for selecting and assigning to a group a pair or more of the car controllers, and performing a group controlling operation by communicating data with a plurality of groups.

The slave car controller 310B performing a backup function includes a group control backup unit 4B, which receives from the first communication unit 1A via the first communicating unit 1B and temporarily stores therein data required to control the car groups, and controls the car groups in place of the group controller when operated as a group controller. The composition of the rest of the slave car controller 310B is identical to that of the master car controller 310A.

The operation of the thusly constituted elevator car group controller system will now be described.

First, the car group control unit 4A in the master car controller 310A and the car group control unit 4B in the slave car controller 310B are respectively provided to make an appropriate allocation of car calls, wherein there are collected car call data through a hall call and a cage call, and a present data of a master car and a slave car. Here, the call data denotes a hall button signal occurring when a passenger waiting for a car pushes a car call button, and a cage button signal occurring when a passenger in an elevator car pushes a desired floor call button, and the present data related to an operating car denotes the location of the car, the number of passengers in the car and the travelling direction of the car.

The car group control unit 4A and the group control backup unit 4B also analyze the collected data and carry out a data processing such as a statistical analysis so as to predict a car traffic amount, and serve to produce a plan for providing a more efficient service and an optimal operation of the elevator cars.

The car group control unit 4A in the master car control unit 310A outputs the collected plan in the form of a control command and an allocation command and allocates the resultant values to the master car controller and the slave car control units.

Also, the control units 4A, 4B monitor the cars to check for a possible error thereof, and when there occurs a breakdown in a car, the corresponding car group controller excludes the disorderly car's so that an allocation command and a control command are not transmitted to the disorderly car's controller.

In the case in which the car controller in charge of controlling a car group becomes disorderly, one of the group selectors 2A, 2B which is in order, selects an orderly car controller among the other car controllers in the group, under a certain criterion, so that the car group control unit 4A in the selected car controller carries out the car group controlling operation.

That is, when the elevator car which is selected as the master car controller 310A becomes malfunctional, the slave car controller 310B is selected so that the car group backup unit 4B which has been carrying out a backup function as the slave car controller 310B then performs the car group controlling operation.

The car control units 3A, 3B control and run a corresponding car in accordance with a running method and an allocation service command which are determined in the car group control unit 4A, and provide a running data to the car group control unit 4A and the car group backup unit 4B.

The car group controller selectors 2A, 2B are required to designate a master car controller when the master car controller selection has to be modified.

There are two instances in which a master car controller is replaced by another car controller. One case is when a normal car group controlling is not possible due to a disorder in the master car controller. Another case is when the master car controller has to be replaced due to modification of a car group controller.

A master car controller having a problem is replaced by one selected from the other car controllers which belong to the same car group, and an exemplary replacement order table is provided as follows.

| Car Controller No. | Group 1 | Group 2 | . . . | Group n |
|---|---|---|---|---|
| 1 | ○ | | | |
| 2 | ○ | | | |
| . | | | | |
| . | | | | |
| . | | | | |
| n − 1 | | | | ○ |
| n | | | | ○ |

Each car controller is assigned a proper number value via a tool such as a switch and set to remember the car group to which it belongs. In the above table, car controllers No. 1 and No. 2 are constituted into group No. 1.

Assuming that the least-numbered value car controller in a group is converted to a master controller, a master car controller can be assigned at any given time.

The operation of the elevator car group controlling apparatus according to the present invention will be further described with reference to the accompanying drawings.

Figure 5:
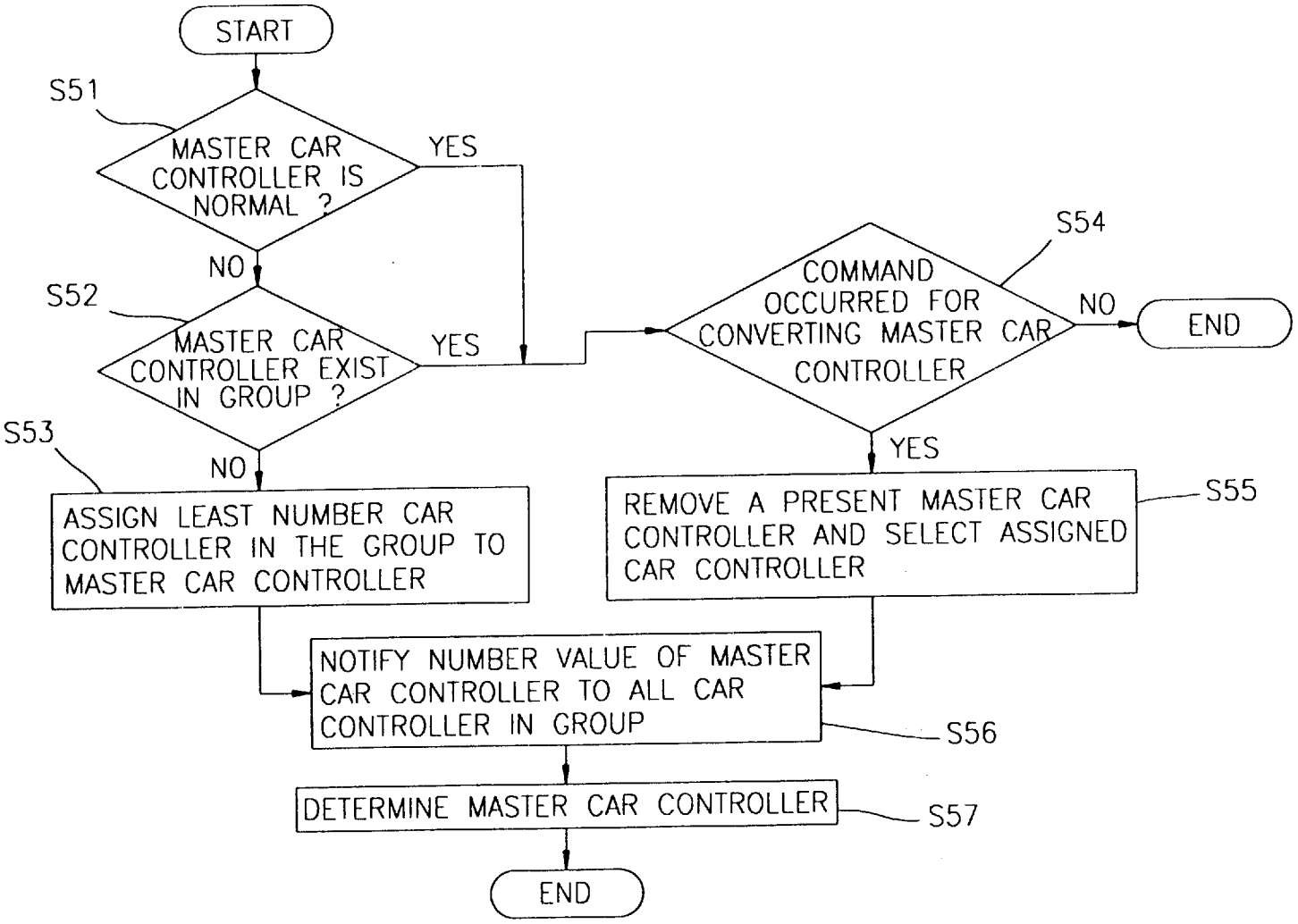
FIG. 5 is a flow chart illustrating a process wherein an elevator car group controller in FIG. 4 selects an elevator car controller.

As shown in FIG. 5 illustrating a process wherein a master car controller is selected when the elevator system begins operating, initially a judgement is made (S51, S52) whether a preset master car controller is normal or whether a master car controller exists within the car group.

When there occurs an error, the proper number value of the corresponding car controller is removed from the car group table, and the group control selector which is aware of the modification of the corresponding group table instantly designates (S53–S55)as a car group controller a car controller which has a lowest numbered value among those car controllers in a corresponding car group, and when the problematic car controller is restored to carry out a normal operation in accordance with a setup manager, the number value of the corresponding car controller is registered in the corresponding group.

Then, the registered number value of the master car controller is notified to the respective car controllers in the group to determine (S56–S57) a master car controller so that each of the car controllers receives an allocation command and a control command value for a master car controller in the corresponding group.

Meanwhile, the group table can be stored in a corresponding one of the ROMs or modified depending on requirements of users in accordance with an external terminal connection.

Next, possible errors in a car controller will be described.

Instances of error occurring in a car controller are divided into a first case wherein a car controller can recognize the error and a second case wherein a car controller does not recognize the error.

When the car controller detects that an error has occurred within itself, it signifies that an error has occurred in components other than a normal CPU, and when the car controller does not detect the error, it means that there is a problem in the CPU.

In the former case, the car controller solves its own problem, and notifies the solved answer to other car controllers, halls and cages to thereby halt the operation.

In the latter case the error is detected by a watchdog function and needs to be solved mechanically therein thus to halt the operation, wherein because the one car controller cannot notify to other car controllers that the error has occurred therein, each of the car controllers are required to diagnose errors in the other car controllers.

Figure 6:
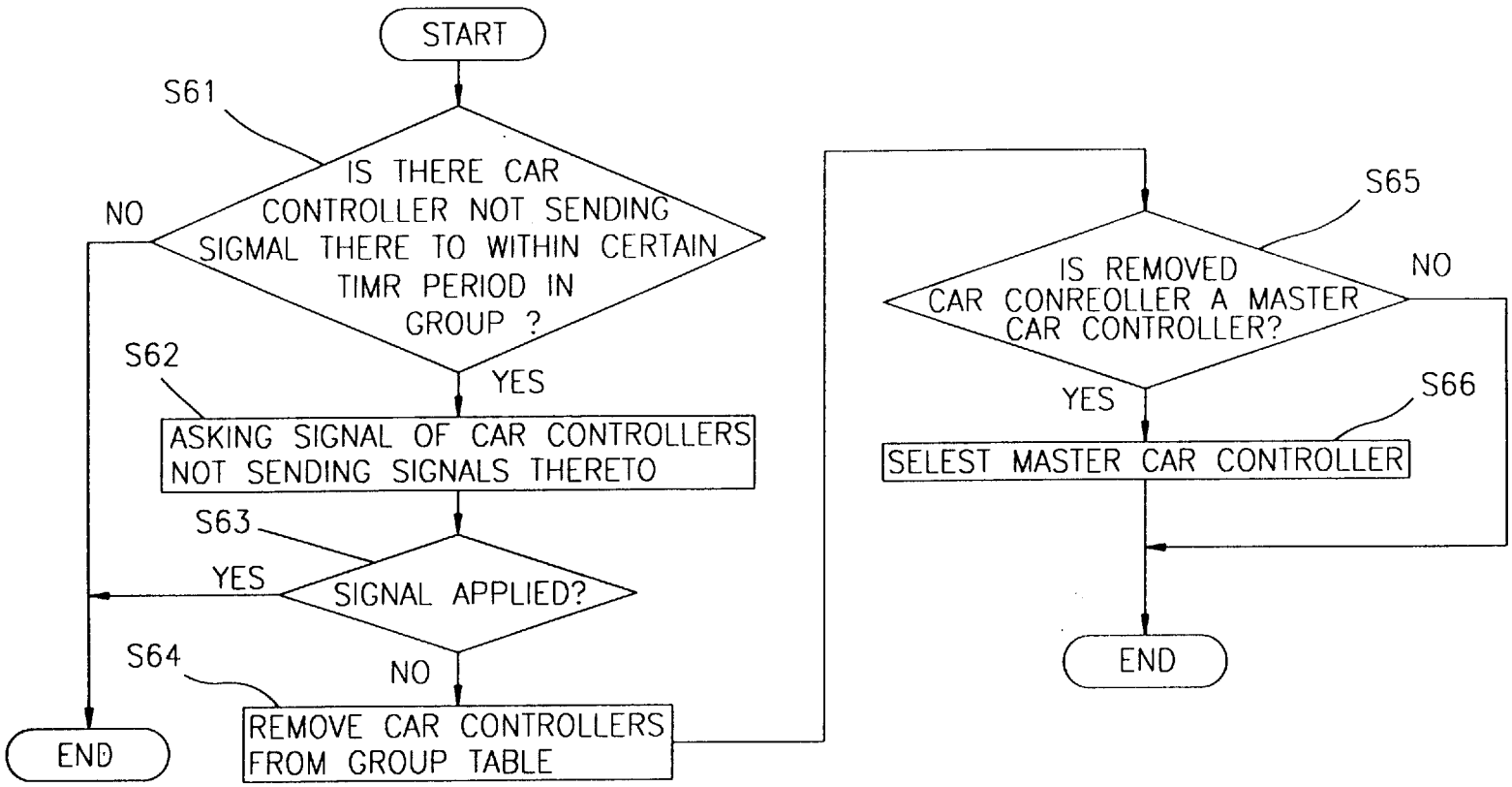
FIG. 6 is a flow chart illustrating a process wherein a group control selector judges a problem car controller and selects a master car controller, according to a first embodiment of the present invention.

Referring to FIG. 6 showing a flow chart of a process according to an embodiment of the present invention wherein the car group selector in FIG. 4 judges a problem car controller and selects an appropriate master controller, each of the car controllers sends a signal via a communication line at least once within a certain time period to the other car controllers in a corresponding group so that when there comes a command in which a signal has to be sent from a slave car controller to a master car controller, the master car controller sends the command signal to the slave car controller.

The master car controller judges (S61) whether a signal is transmitted from the slave car controller to the master controller and, if not, sends (S62) a command signal to the slave car controller to ask for a transfer signal. If a signal is not transferred (S63) from the slave car controller to the master car controller, the slave car controller is diagnosed as suffering a breakdown, to thereby exclude (S64) the brokendown car controller from the car group table. If the excluded car controller is a master car controller, a car group selector becomes driven so that a new master car controller is selected (S65, S66) among the car controllers in the car group table. The allocation can be realized with ease because the newly selected master car controller has also been collecting all the data about the car controllers.

Figure 7:
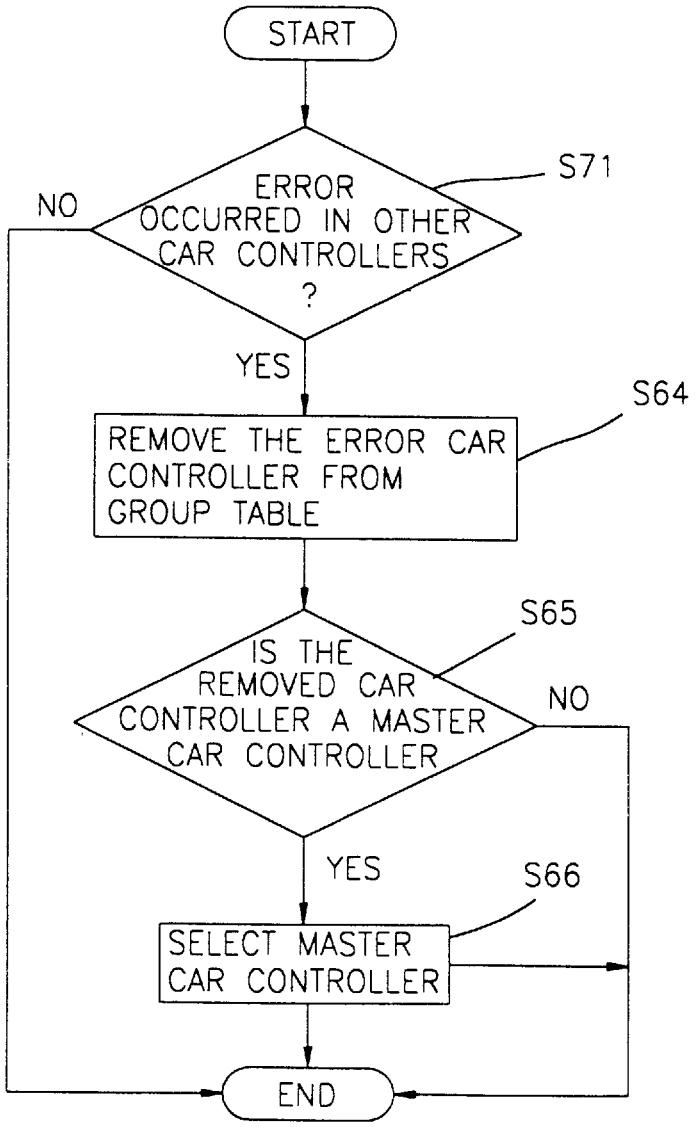
FIG. 7 is a flow chart illustrating a process wherein a group control selector judges a problem car controller and selects a master car controller, according to a second embodiment of the present invention.

FIG. 7 shows a process of an another embodiment of the present invention, wherein a step S71 denotes that there has occurred a breakdown in another car controller.

As described above, car controllers which belong to a same car group have a respective proper number value, and can be assigned to another car group whenever required, in accordance with the modification of the external monitoring system, and also data can be shared between car controllers within the same group.

Figure 8:
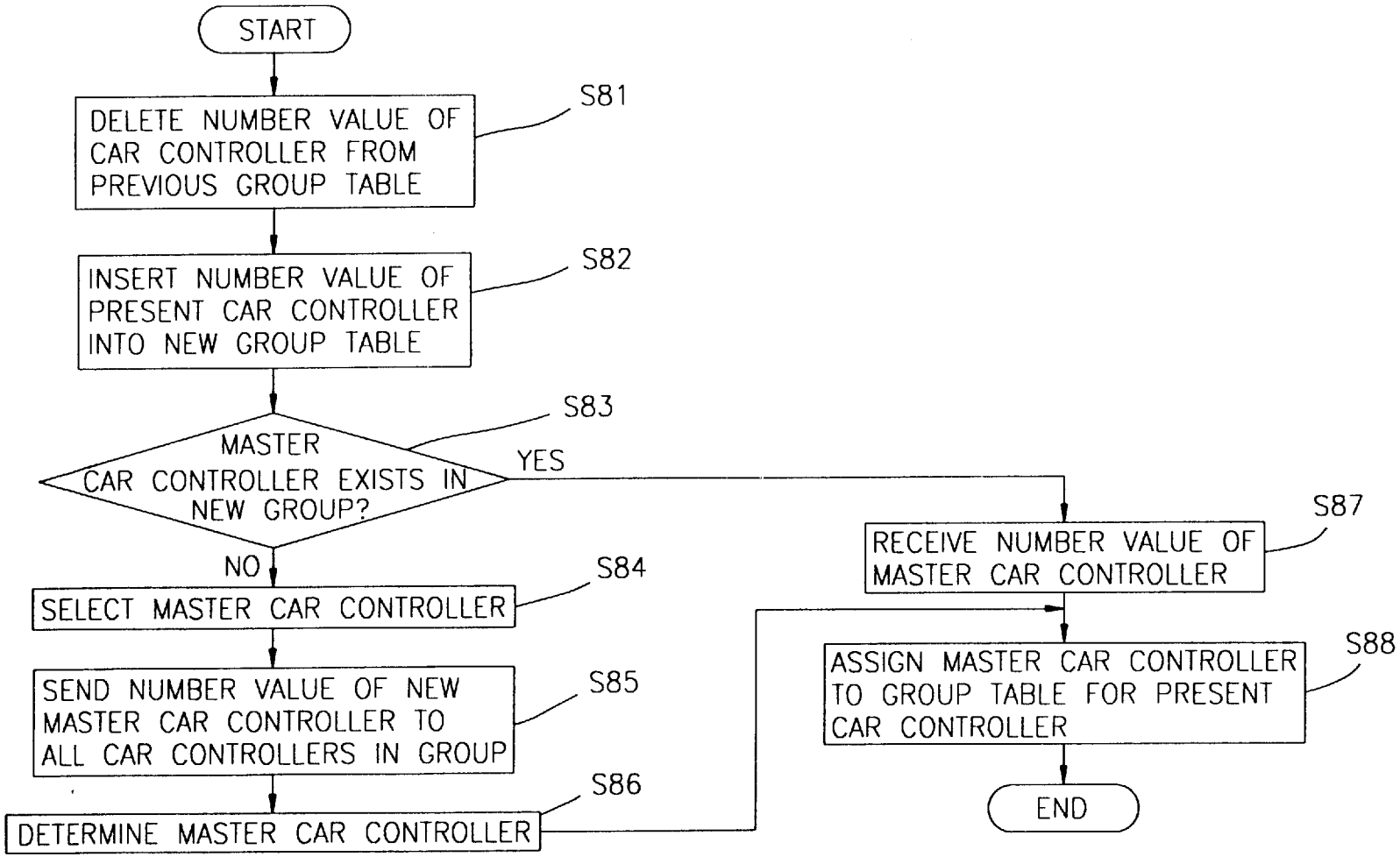
FIG. 8 is a flow chart illustrating a process for modifying a car grouping, according to the present invention.

The car group modification process is shown in FIG. 8, wherein the number value of a car controller which needs re-assignment is deleted (S81) from its original group table and inserted (S82) into a new group table. If there exists a master car controller in the newly assigned group, the number of the re-assigned car controller is received from the master car controller, so that the number of the master car controller is assigned (S87, S88) to the car group to which an assigned car controller belongs. When there does not exist a master car controller, a new master car controller is selected so that the number of the newly selected master car controller is transferred to each of the other car controllers in the same group, thereby determining (S84, S85, s86, s88) the selection of the master car controller.

Subsequently, when there are provided a number n of car groups there are also provided a number n of car controllers each of which performs a car group controlling operation. By such composition, a plurality of elevator cars can be assigned to one group selected from appropriate groups depending on a reconstruction or a structural modification of a building so that a car group can be operational, whereby a plurality of car group control systems can be obtained which have not been available in the conventional art, thus to improve the efficiency of passenger carriage in the building.

Therefore, a car group controller in charge only of car groups is not required and because each of the car controllers can carry out a car group control and backup function, an error preparation capability can be significantly improved proportional to the increased number of the car controllers within a car group.

Further, the error generation rate can be decreased in accordance with the decreased components of the system.

Still further, the car group controller in the master car controller sends an allocation and control command signals to the present car and other cars but the car group controller in the slave car controller does not send a command signal to the present car or other cars so that practically the car group control unit and the group control backup unit have only the practical difference as to whether to send a command signal to the other cars and otherwise remain the same, and as such their composition and operation remain identical, thereby realizing a standardization of elevator car controllers and decreased cost in the maintenance as well as production thereof.

What is claimed is:

1. An apparatus for controlling a plurality of elevator groups each of which has at least a pair of elevator cars, comprising:

a master car controller for collecting data from and controlling a plurality of hall calls, cage calls and motors to thereby manage a respective group of elevators cars, the master car controller comprising:

a car group control unit for collecting and analyzing car call data and car run data, and outputting a control command and an allocation command value;

a car control unit for receiving the control command and the allocation command value from the car group control unit thus to control a corresponding elevator car, and providing a relevant run data of the corresponding elevator car to the car group control unit; and a car group control selector for judging whether the corresponding car control unit is in charge of a car group controlling operation and storing respective number values for car controllers under the car group controlling operation in an internal group table, wherein a new master car controller is selected when there occurs an error in the previously selected master car controller by removing a number value of a car controller from a car group table if a signal is not periodically app lied therefrom to the other car controllers in the car group, and selecting as a new master car controller another car controller from the group table if the removed number value corresponds to a car controller which is a master car controller, and at least one slave car controller for receiving and internally backing up an allocation command and control command value from the master car controller to thereby control the hall calls, the cage calls and the motors in accordance therewith.

2. The apparatus of claim 1, wherein when there occurs an error in the master car controller, the car group control selector removes the number value of the affected master car controller from the group table, and when the master car controller again becomes normal in operation the number value of the master car controller is again listed in the group table of the corresponding car group.

3. The apparatus of claim 1, wherein the slave car controller comprises:

a car group managing backup unit for receiving from the master car controller and storing therein data required to manage a car group;

a car control unit for receiving the control command and the allocation command value from the master car controller to thereby control running of a corresponding elevator car, and providing a relevant running data of the corresponding car to the car group managing backup unit; and a car group managing selector for judging whether a corresponding car controller is in charge of a car group controlling operation, and storing proper number values of corresponding car controllers which belong to the corresponding car group in an internal group table.

4. The apparatus of claim 1, wherein when there occurs an error in the master car controller the car group managing selector assigns the slave car controller as the car controller in charge of the car group controlling operation so that the listed number value of the slave car controller is transmitted to other car controllers in the car group.

5. A method for controlling a plurality of elevator groups each of which has at least a pair of elevator cars, wherein each of the groups carries out an independent car group controlling operation, comprising:

a first step for selecting a car controller serving as a master car controller which performs a car group controlling operation, from among a plurality of car controllers and setting the rest of the plurality of car controllers other than the selected master controller as slave car controllers;

a second step for selecting as a new master car controller a car controller from among the slave car controllers when there occurs an error in the previously selected master car controller, the second step further comprising:

removing a number value of a car controller from a car group table if a signal is not periodically applied therefrom to the other car controllers in the car group; and selecting as a new master car controller another car controller from the group table if the removed number value corresponds to a car controller which is a master car controller; and a third step for notifying the selection of the master car controller to the other car controllers.

6. The method of claim 5, wherein the second step further comprises:

removing a number value of a car controller from the group table when a signal notifying an error thereof is applied to the other car controllers in the car group; and selecting another car controller for serving as a master car controller from the group table if the removed number value corresponds to a car controller which is the master car controller.

7. The method of claim 5, further comprising:

a step for removing from the group table a number value of a car controller which is to be re-assigned and enlisting the same in a new group table;

a step for selecting a master car controller if there is not one in the new group table; and a step for listing in the new group table a number value of the newly selected master car controller.

* * * * *